US005430521A

United States Patent [19]

Wernicke

[11] Patent Number: 5,430,521

[45] Date of Patent: Jul. 4, 1995

[54] DEVICE FOR THE DEVELOPMENT OF PHOTOGRAPHIC SILVER HALIDE MATERIAL

[75] Inventor: Ubbo Wernicke, Rösrath-Kleineichen, Germany

[73] Assignee: Agfa Aktiengesellschaft, Leverkusen, Germany

[21] Appl. No.: 130,988

[22] Filed: Oct. 4, 1993

[30] Foreign Application Priority Data

Oct. 14, 1992 [DE] Germany ..... 42 34 639.8

[51] Int. Cl.[6] ..... G03D 3/08

[52] U.S. Cl. ..... 354/320; 354/321

[58] Field of Search ..... 354/319–323; 134/64 P, 64 R, 122 P, 122 R

[56] References Cited

U.S. PATENT DOCUMENTS

| | | | |
|---|---|---|---|
| 3,839,040 | 10/1974 | Goldstein | 354/321 |
| 4,063,324 | 12/1977 | Junge | 15/100 |
| 4,081,815 | 3/1978 | Horner | 354/319 |
| 4,464,035 | 8/1984 | Schoering | 354/322 X |
| 4,613,223 | 9/1986 | Cherry et al. | 354/322 |
| 5,046,286 | 9/1991 | Holyoke | 51/137 |
| 5,177,522 | 1/1993 | Hayashi | 354/320 |

FOREIGN PATENT DOCUMENTS 2218792 10/1973 Germany .

*Primary Examiner*—D. Rutledge
*Attorney, Agent, or Firm*—Connolly & Hutz

[57] ABSTRACT

A device for processing a photographic silver halide material, comprising a tank which is filled with a photographic processing bath, through which the photographic material is continuously conducted at a specified conveyance speed, and in which, below the level of the bath, is arranged at least one driven roller which can rotate at a peripheral speed which differs from the conveyance speed of the photographic material and the surface of which is in contact with the photographic material on the emulsion side, facilitates a reduction in the processing time or, in the case of an unchanged processing time, improved processing reliability.

2 Claims, 1 Drawing Sheet

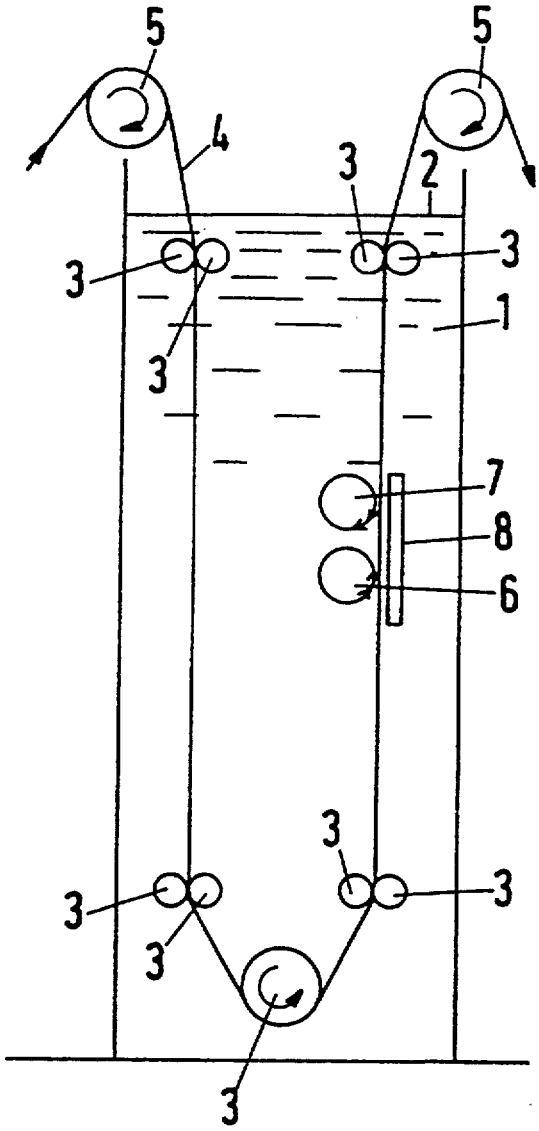
5
5
4
3
2
3
3
3
1
7
8
6
3
3
3
3
3

DEVICE FOR THE DEVELOPMENT OF PHOTOGRAPHIC SILVER HALIDE MATERIAL

The invention relates to an improved device for the processing of photographic silver halide material which facilitates a further reduction in the processing time or, in the case of an unchanged processing time, improves processing reliability.

Commercially available colour papers based on silver halide emulsions with a high chloride content are processed in accordance with a procedure known as the "RA 4-process" which is characterised by a development time of only 45 seconds at 35° C. The yellow couplers contained in the commercially available materials are characterised by relatively slow coupling kinetics, so that the 45 seconds are virtually entirely used up in the formation of the yellow partial image, particularly as the layer which forms the yellow dye is normally the lowest layer of the material. If the activity of the developing agent is reduced due to relatively long use or insufficient regeneration, the yellow dye formation becomes inadequate within a very short period of time.

For this reason it is possible to reduce the development time to below the currently required 45 seconds only if the activity of the developing solution is increased. It can be attempted to increase the activity of the developer by the use of different measures, for example, an increase in temperature, an increase in the concentration of the active ingredient in the developing bath, improved recirculation of the developing bath.

An increase in temperature is subject to limits as above 35° C. the evaporation of the baths becomes problematic and the stability of the baths is thereby reduced. A chemical increase in the activity by increased concentration of the active ingredients is inadvisable for ecological reasons as at the present time the use of increasingly more dilute, i.e. ecologically more favourable, processing paths is to be striven towards. Improved agitation compared to that attained by conventional pump-operated circulation of the photographic baths can be achieved by the use of special agitation pumps which spray the processing paths through flat nozzles towards the photographic material. However, in the case of all these measures a distinctive reduction in the processing time is possible only to a very limited extent.

SUMMARY OF THE INVENTION

Surprisingly it has now been discovered that a substantial reduction in the processing time in a photographic bath can be achieved if below the level of the bath the material is brought into contact on the emulsion side with at least one rotating roller, the peripheral speed of which does not correspond exactly to the conveyance speed of the photographic material. Preferably the rotating roller is a soft roller, the surface of which consists, for example, of soft rubber, sponge rubber or textile plush. The motion of this roller is either slower or faster than that of the photographic material. In particular, the direction of rotation of the roller can be opposed to the direction of conveyance of the photographic material. Rotation speeds of up to 100 m/min are permissible. The roller can also be stationary (rotation speed 0 m/min).

Depending upon the geometric configuration of the developing machines, preferably a plurality of such rollers, which need not necessarily all exhibit the same direction of rotation, can also be used. To prevent the photographic material from becoming displaced from the rollers according to the invention in the event of a slackening of the conveying tension, with the result that the surface contact of the photographic material would no longer be obtained, the material is preferably held in position by means of counterpressure plates which are disposed on the other side of the photographic material opposite the rollers, where the guidance of the photographic material can be assisted by means of lateral guide elements. In place of these plates it is also possible to use rotating rollers which, however, do not exert a beneficial effect on the development result as they contact the photographic material only on the rear side.

BRIEF DESCRIPTION OF THE DRAWING

FIG. 1 is a cross-section through a preferred embodiment of the device according to the invention.

DETAILED DESCRIPTION OF THE INVENTION

In the tank 1, filled with a processing fluid up to the level 2, are arranged guide rollers 3 via which the photographic material 4 is conveyed in the direction of the arrow. Guide rollers 5 are also arranged above the bath. The rollers 6 and 7, which rotate in mutually opposed directions at a different speed to the speed of conveyance of the material, are arranged in the bath. At the level of these driven rollers, the pressure plate 8, which prevents the displacement of the material 4, is arranged on the rear side of the photographic material.

EXAMPLE 1

A photographic colour recording material based on silver halide emulsions with a high chloride content is mechanically processed in accordance with the RA 4-process with normal agitation. The development time amounts to 45 seconds at 35° C., and the bleach fixing time likewise amounts to 45 seconds at 35° C. Then a stabilizing bath treatment is carried out for 4 times 22.5 seconds at 35° C. in counterflow. The conveyance speed amounts to 6 m/min.

The maximum densities shown in Table 1 are obtained.

Identical results are obtained if the stabilization treatment is replaced by water washing for 4 times 22.5 seconds at 35° C. in counterflow.

EXAMPLE 2

The procedure according to Example 1 is followed, but the development time is reduced to 25 seconds by an appropriate increase in the conveyance speed. The results are again shown in Table 1. It will be apparent that the magenta and cyan densities virtually attain the standard type values, whereas the yellow density falls to an extremely low value.

EXAMPLE 3

The procedure according to Example 2 is followed, but six rollers with a diameter of 3 cm are installed in the developing bath, which rollers contact the photographic material on its emulsion side and possess mutually opposed directions of rotation. These rollers rotate at a peripheral speed which is 5% greater than the conveyance speed of the photographic material.

The maximum densities attained in this way are again shown in Table 1. It will be apparent that although the processing time has been approximately halved, even in the case of yellow the standard type density is virtually attained again.

TABLE 1

| | Maximum Densities | | |
|---|---|---|---|
| | Yellow | Magenta | Cyan |
| Example 1 | 2.20 | 2.57 | 2.53 |
| Example 2 | 1.19 | 2.49 | 2.60 |
| Example 3 | 1.95 | 2.61 | 2.62 |

I claim:

1. A process for processing a photographic silver halide material wherein the silver halide material is continuously conducted, at a specified conveyance speed, through at least one tank filled with a photographic processing bath, characterized in that the emulsion side of the photographic material is brought into contact with the surface of at least one driven roller arranged in the tank below the level of the bath, where the roller has a peripheral speed which differs from the conveyance speed of the material, possesses a soft surface and rotates in the opposite direction to the direction of conveyance of the photographic material.

2. A process as claimed in claim 1, characterised in that at least two rollers are provided which rotate in mutually opposed directions at a peripheral speed which differs from the conveyance speed of the material.

* * * * *